US008564506B2

(12) United States Patent
Ietomi

(10) Patent No.: US 8,564,506 B2
(45) Date of Patent: Oct. 22, 2013

(54) CORRECTION CIRCUIT AND DISPLAY DEVICE

(75) Inventor: Kunihiko Ietomi, Kanagawa (JP)

(73) Assignee: Sony Corporation, Tokyo (JP)

( * ) Notice: Subject to any disclaimer, the term of this patent is extended or adjusted under 35 U.S.C. 154(b) by 715 days.

(21) Appl. No.: 12/846,014

(22) Filed: Jul. 29, 2010

(65) Prior Publication Data

US 2011/0032264 A1 Feb. 10, 2011

(30) Foreign Application Priority Data

Aug. 5, 2009 (JP) ..... P2009-182819

(51) Int. Cl.
*G09G 3/30* (2006.01)

(52) U.S. Cl.
USPC ..... 345/76

(58) Field of Classification Search
USPC ..... 345/76–77, 82–83; 315/169.3
See application file for complete search history.

(56) References Cited

U.S. PATENT DOCUMENTS

2004/0150592 A1 8/2004 Mizukoshi et al.
2006/0061560 A1 3/2006 Yamashita et al.
2006/0284802 A1* 12/2006 Kohno ..... 345/76
2007/0008251 A1 1/2007 Kohno et al.
2007/0210996 A1* 9/2007 Mizukoshi et al. ..... 345/77
2010/0039422 A1* 2/2010 Seto ..... 345/212

FOREIGN PATENT DOCUMENTS

JP 2004 264793 9/2004
JP 2006 84899 3/2006
JP 2007 18876 1/2007
JP 2008 252101 10/2008

* cited by examiner

*Primary Examiner* — Chanh Nguyen
*Assistant Examiner* — Robert Stone
(74) *Attorney, Agent, or Firm* — Frommer Lawrence & Haug LLP; William S. Frommer

(57) ABSTRACT

A correction circuit includes a memory that stores a mobility correction value or a threshold voltage correction value for correcting luminance non-uniformity for every pixel, a memory read-out unit that reads out the mobility correction value or the threshold voltage correction value from the memory, a correlation table that produces a threshold voltage correction value or a mobility correction value from the other one of the mobility correction value and the threshold voltage correction value on the basis of a correlation between mobility and a threshold voltage, a mobility correction unit correcting an input signal for every pixel by using the mobility correction value supplied from the memory read-out unit or the correlation table, and a threshold voltage correction unit correcting the input signal that is corrected at the mobility correction unit, by using the threshold voltage correction value supplied from the memory read-out unit or the correlation table.

10 Claims, 6 Drawing Sheets

CORRECTION CIRCUIT AND DISPLAY DEVICE

BACKGROUND OF THE INVENTION

1. Field of the Invention

The present invention relates to a correction circuit and a display device that correct display non-uniformity occurring in a display device in which display elements are arranged in matrix.

2. Description of the Related Art

In an organic EL display device, organic EL elements, which are self-emissive elements, are used as pixels. A luminance level (gradation) of each of the organic EL elements, that is, light emitting elements, arranged in matrix can be controlled by a current flowing in the elements. Thus the organic EL display device is a current controlled device (current drive method) and therefore greatly differs from a voltage controlled device such as a liquid crystal display device.

Organic EL display devices employ a passive matrix method or an active matrix method as a driving method thereof. In recent years, organic EL display devices employing the active matrix method have been extensively developed. In the active matrix method, a current flowing in a light emitting element in each pixel circuit is controlled by an active element provided in a pixel circuit. A thin film transistor (TFT) is commonly used as the active element, and is called a driving transistor due to its function.

In a TFT panel in which TFTs are arranged in matrix, a relationship between potential of an input signal and light emitting luminance in each pixel corresponds to a relationship between a gate applied voltage and a drain current in a driving transistor of a pixel (see Japanese Unexamined Patent Application Publication No. 2006-84899, for example).

An operating characteristic of a driving transistor is expressed as Expression 1 below.

$$Ids=(1/2)\mu(W/L)Cox(Vgs-Vth)^2 \quad (1)$$

In Expression 1, Ids denotes a drain current flowing between a source and a drain, that is, an output current supplied to a light emitting element in a pixel circuit. Vgs denotes a gate voltage applied to a gate with reference to the source, that is, input potential mentioned above in the pixel circuit. Vth denotes a threshold voltage of the transistor. μ denotes mobility of a carrier in a semiconductor thin film constituting a channel of the transistor. W denotes a channel width, L denotes a channel length, and Cox denotes a capacitance.

In a TFT including a semiconductor thin film of polysilicon, a threshold voltage Vth and mobility μ (V-I) characteristic) commonly have a variation (see Japanese Unexamined Patent Application Publicastion Nos. 2006-84899 and 2007-18876, for example). Tha variation of the threshold voltage Vth and the mobility μ cause luminance non-uniformity for every pixel, causing color non-uniformity and display non-uniformity.

In recent years, a silicon film of a polysilicon TFT is commonly formed by a laser annealing method in which amorphous silicon is crystallized by laser. However, a crystalline semiconductor film formed by the method has a structure including a plurality of crystalline grains. It has been difficult to control positions and sizes of the crystalline grains (see Japanese Unexamined Patent Application Publication No. 2008-252101, for example). The distribution characteristic of the crystalline grains influences both of mobility of a carrier in a channel region and a threshold voltage of the transistor (see Japanese Unexamined Patent Application Publication No. 2008-252101 and "Statistical Analyses of the Influence of Grain Boundary Variations in Poly-Si TFTs", Technical Report of IEICE, VLD, VLSI Design Technologies, The Institute of Electronics, Information and Communication Engineers, Vol. 102 (No. 344), pp. 25-30 (Sep. 23, 2002), for example).

In a case of correction of luminance non-uniformity by signal processing, the correction has been commonly performed by calculating these two values (see Japanese Unexamined Patent Application Publication Nos. 2006-84899, 2004-264793, and 2007-18876). FIG. 1 illustrates characteristic curves showing a relation between an input signal voltage and light emitting luminance in a case where a threshold voltage in one pixel is shifted from a threshold voltage of the other pixel by Vth' and mobility in the one pixel is multiplied by μ' with respect to mobility in the other pixel, in two pixels. In FIG. 1, a horizontal axis indicates an input signal voltage V and a vertical axis indicates an output current I (corresponding to output luminance). In FIG. 1, a characteristic curve 2*a*, which is drawn by a dashed line, of a specific pixel is an example of a curve in a case where a threshold voltage is shifted by Vth' with respect to a characteristic curve 1 of an adjacent pixel (a part of an arrow in a horizontal direction). A characteristic curve 2 is an example of a curve in a case where the output current I is corrected so that the mobility is multiplied by μ' with respect to the characteristic curve 2*a* (a part of an arrow in an upward direction).

In this case, the output current I corresponding to a part of the characteristic curve 2 in an area where the light emitting luminance of an intended pixel changes linearly with respect to the input signal voltage (neighborhood of a dashed-dotted line) is multiplied by Δμ, which satisfies an equation Δμ=1/μ'. Then, ΔVth, which satisfies an equation ΔVth=−Vth' is added to the input signal voltage V corresponding to a part of the characteristic curve 1. By doing this operation on the basis of Expression 1, accurate correction may be achieved.

FIG. 2 illustrates a block diagram for correcting a threshold voltage and mobility.

A correction circuit 20 shown in FIG. 2 corrects luminance data on the basis of mobility correction data that is pre-stored in a memory 22*a* and threshold voltage correction data that is pre-stored in a memory 25*a* so as to supply the corrected luminance data to a display panel 10 (TFT panel).

The display panel 10 has a pixel of respective colors of red, green, and blue (RGB). Input data (pixel data: luminance data) which are voltage signals of luminance of each pixel are inputted separately for each of the colors of RGB, whereby the display panel 10 is capable of controlling a display of every color. Here, a coordinate of a dot in a display area is denoted as (X, Y).

R data, G data, and B data are respectively supplied to a multiplier 21R, a multiplier 21G, and a multiplier 21B. To the multipliers 21R, 21G, and 21B, correction values Δμ for correcting variation of mobility for every pixel are respectively supplied. The correction values are read out from the memory 22*a* by a memory read-out unit 22 on the basis of a coordinate signal (X coordinate, Y coordinate).

Outputs of the multipliers 21R, 21G, and 21B are supplied to square root operation units 23R, 23G, and 23B determining a square root. Outputs of the square root operation units 23R, 23G, and 23B are respectively supplied to adders 24R, 24G, and 24B.

To the adders 24R, 24G, and 24B, correction values ΔVth for correcting variation of threshold voltages for every pixel are respectively supplied from a memory read-out unit 25 which reads out the correction values ΔVth from the memory 25*a* on the basis of the coordinate signal (X coordinate, Y coordinate).

Then outputs of the adders 24R, 24G, and 24B are respectively supplied to D/A converters 26R, 26G, and 26B and converted into analog data signals so as to be supplied to input terminals of respective colors in the display panel 10. Consequently, an organic EL element is driven in each pixel by currents corresponding to the data signals of respective colors that are corrected for every pixel.

As above, luminance non-uniformity occurring in an organic EL element due to a problem in manufacturing may be corrected. However, as mentioned above, two correction values of the mobility μ and the threshold voltage Vth are stored in a memory for every pixel, resulting in a problem of greatly large-size data depending on the number of pixels.

In view of the above, Japanese Unexamined Patent Application Publication No. 2004-264793 discloses a display device in which a display area is divided into small areas in a display panel having a large number of pixels. In the device, a coefficient for correcting the whole of the display area is calculated by measuring a current in each of the small areas and estimating a trend of the whole of the display area, or correction is performed in each of the small areas.

SUMMARY OF THE INVENTION

However, in the technique disclosed in Japanese Unexamined Patent Application Publication No. 2004-264793, since the display panel is divided into small areas and a trend of the whole of the display panel is calculated by a small area unit, it is difficult to accurately perform correction for every pixel. Further, though a storage capacity of the memory can be kept small in the case of the correction in the small area unit, it is still difficult to accurately perform the correction for every pixel.

It is desirable to provide a display device in which a storage capacity of a memory is kept small and luminance non-uniformity can be corrected for every pixel.

The applicant of the present invention measured mobility and a threshold voltage of a real TFT which had been formed by using the technique of Japanese Unexamined Patent Application Publication No. 2008-252101. From the measurement, the applicant of the present invention realized that variations of the mobility and the threshold voltage had a certain level of correlation, though it was seemed that this was because the mobility and the threshold voltage depend on distribution of crystalline grains. FIG. 3 illustrates an example of correlation between a threshold voltage Vth and mobility μ. FIG. 3 shows such correlation that the threshold voltage Vth is large when the mobility μ is small and the threshold voltage Vth decreases as the mobility μ increases.

Accordingly, such case is considered that a threshold voltage correction value ΔVth is not stored in a memory but is produced from a mobility correction value Δμ in a correction circuit by using a correlation table which is prepared.

A correction circuit according to an embodiment of the present invention includes a memory configured to store one of a mobility correction value and a threshold voltage correction value that are used for correcting luminance non-uniformity, which is caused by mobility of a carrier in a channel region and a threshold voltage of a driving transistor included in a pixel circuit of a pixel constituting a display panel and being a correction object, for every pixel, a memory read-out unit configured to read out one of the mobility correction value and the threshold voltage correction value that are stored in the memory, a correlation table configured to produce one of a threshold voltage correction value and a mobility correction value from the other one of the mobility correction value and the threshold voltage correction value that are read out by the memory read-out unit, on the basis of a correlation between the mobility and the threshold voltage, a mobility correction unit for correcting an input signal for every pixel by using the mobility correction value supplied from one of the memory read-out unit and the correlation table, and a threshold voltage correction unit for correcting the input signal, which is corrected at the mobility correction unit, for every pixel by using the threshold voltage correction value supplied from one of the memory read-out unit and the correlation table.

According to the embodiment of the present invention, luminance non-uniformity occurring in a pixel of the display panel can be corrected for every pixel. Further, only one of the mobility correction value and the threshold voltage correction value which are used for correction processing in the pixel circuit of each pixel is stored in the memory and the other one of the correction values is produced in the correction circuit with reference to the correlation table. Therefore, the memory does not take more storage capacity.

According to the embodiment of the present invention, luminance non-uniformity may be corrected in every pixel while keeping the storage capacity of the memory small, being able to suppress display non-uniformity with accuracy.

DESCRIPTION OF THE PREFERRED EMBODIMENTS

Embodiments of the present invention will now be described with reference to the accompanying drawings in the following order.

1. Embodiment (a correlation table: an example of a case where ΔVth is produced from Δμ)
2. Another embodiment (a correlation table: an example of a case where Δμ is produced from ΔVth)

1. Embodiment

According to Expression 1 above, in an active matrix TFT panel based on a current driving method, a drain current (output current I) of a driving transistor in a pixel circuit is proportional to mobility μ and is proportional to the square of a difference between a gate applied voltage Vgs and a threshold voltage Vth. That is, accuracy of the drain current (output current I) of a driving transistor depends on accuracy of the mobility μ and accuracy of the square of the difference between the gate applied voltage Vgs and the threshold voltage Vth.

In the light of the such characteristic of the output current of the driving transistor, in an embodiment of the present invention, a correction value of the mobility μ and a correction value of the threshold voltage Vth are determined, correction processing is performed with respect to an input signal in a manner to inversely calculate Expression 1 by using the correction values, and an output produced through the correction processing is supplied to each pixel of a TFT panel.

Namely, in the embodiment, an input signal voltage is multiplied by Δμ which satisfies Δμ=1/μ' in an area in which the input signal voltage is expressed in a linear fashion with respect to light emission luminance of an intended pixel, on the basis of Expression 1. Further, ΔVth which satisfies ΔVth=−Vth' in the input signal area is added so as to accurately correct the input signal. Here, a correlation table between the mobility correction value Δμ and the threshold voltage correction value ΔVth (LUT: look-up table) is preliminarily provided to a correction circuit so as to produce a threshold voltage correction value ΔVth in response to an input of the mobility correction value Δμ.

Figure 1:
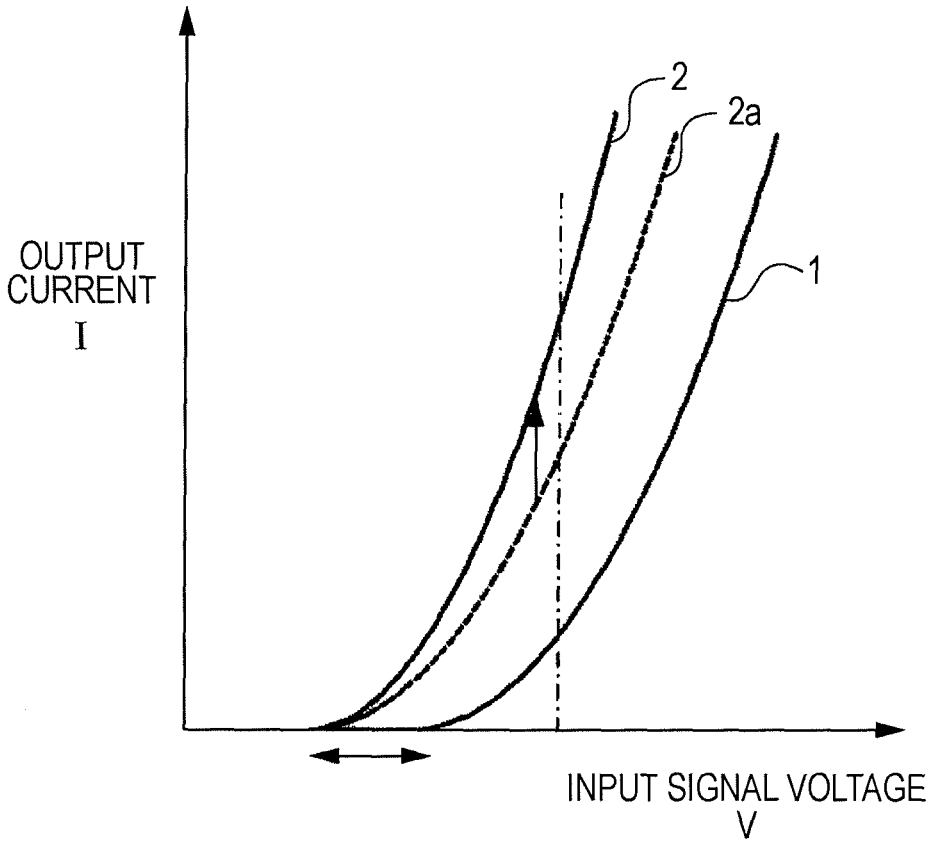
FIG. 1 is a graph showing an example of a relationship between an input signal voltage and light emitting luminance in two pixels.
Figure 2:
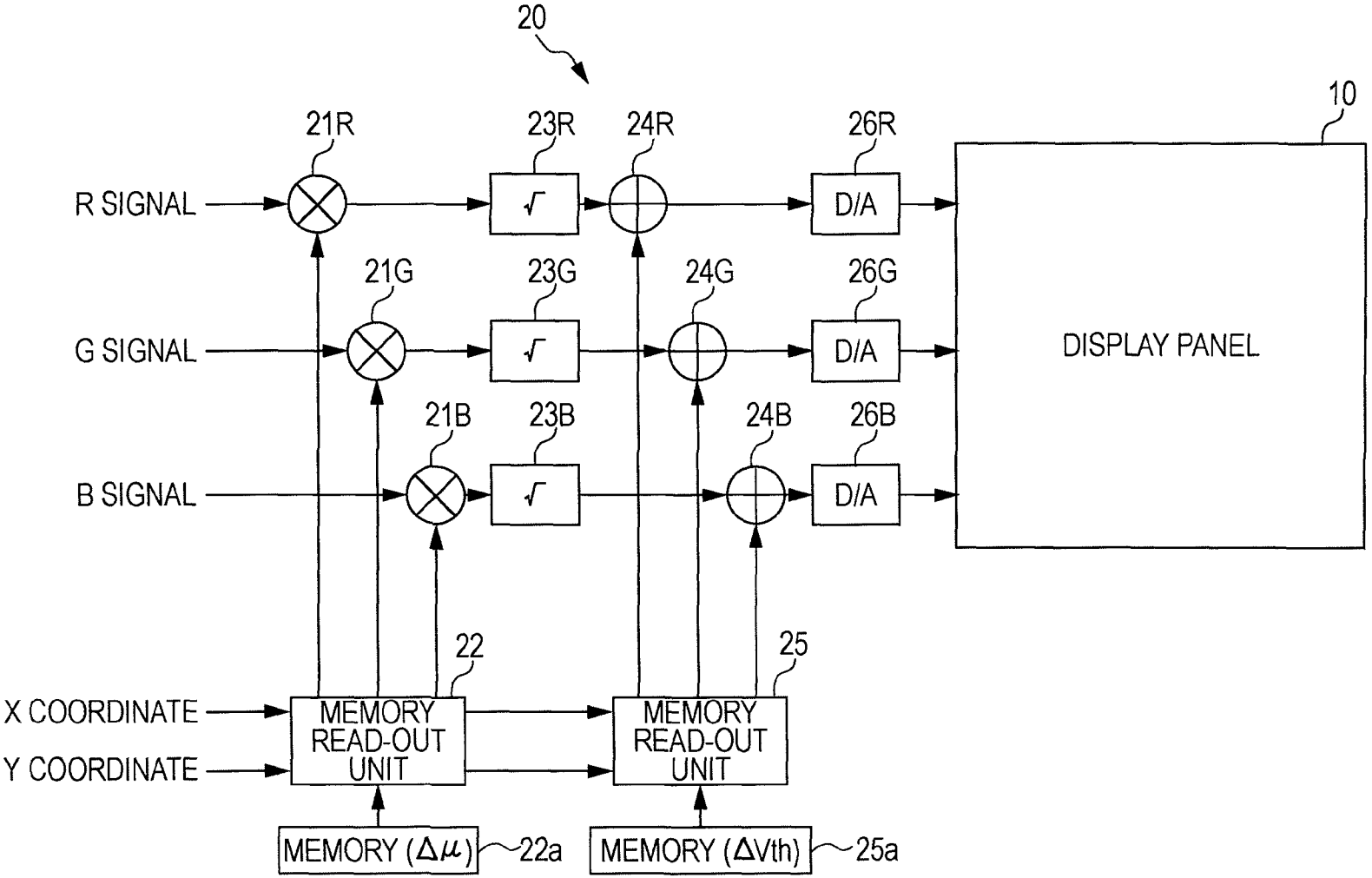
FIG. 2 illustrates a block diagram for correcting a threshold voltage and mobility.
Figure 3:
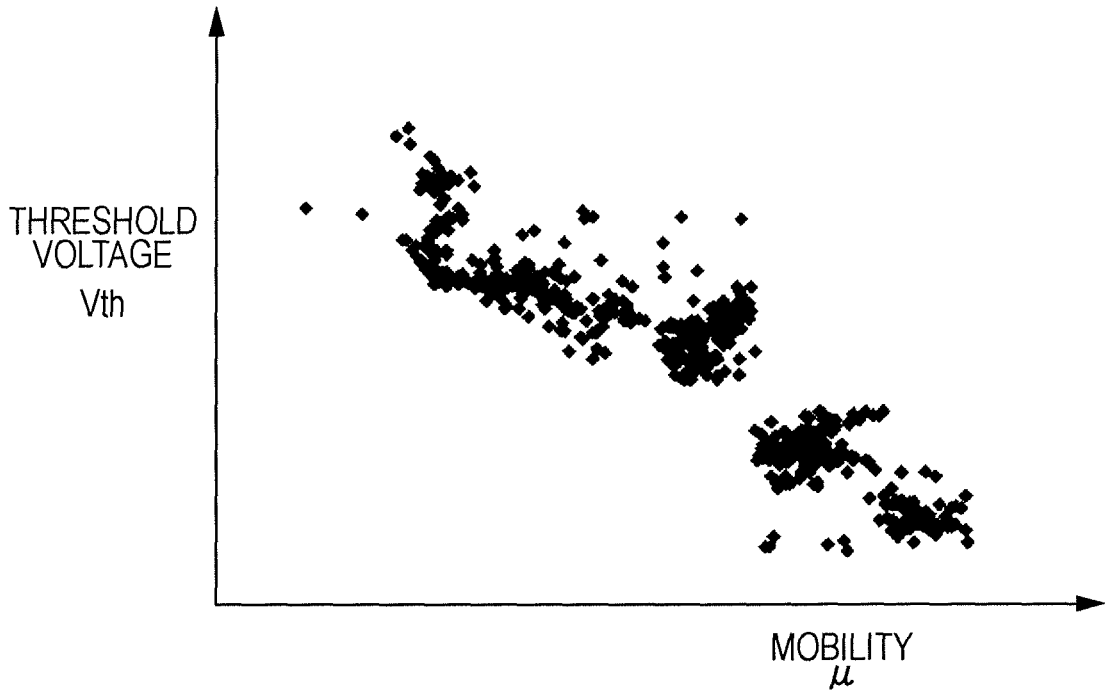
FIG. 3 is a graph showing a correlation between a threshold voltage and mobility.
Figure 4:
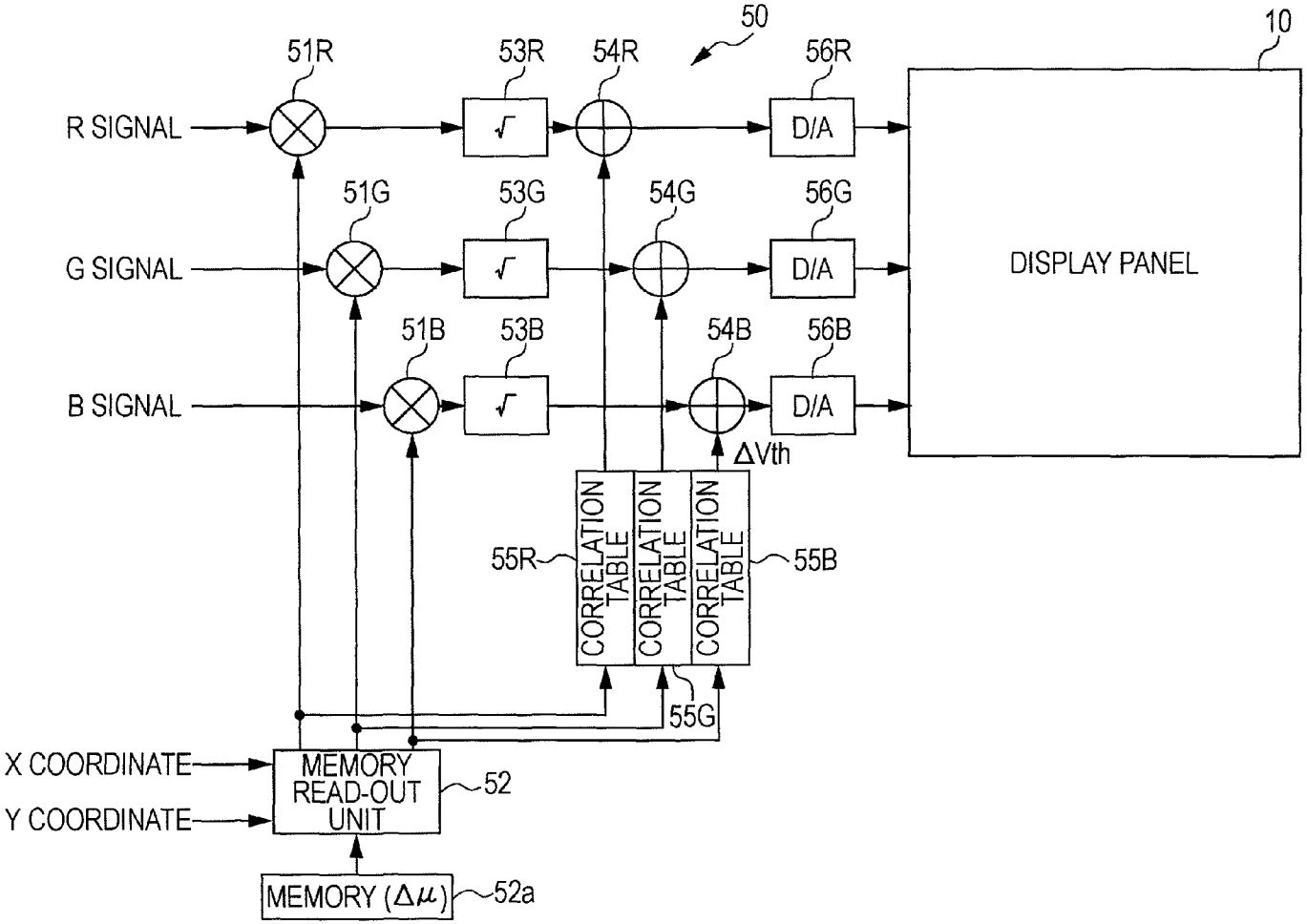
FIG. 4 shows an embodiment of a block diagram for correcting a threshold voltage and mobility.

FIG. 4 illustrates a structure example of a display device, according to the embodiment of the present invention, which is applied to an organic EL display device. This organic EL display device according to the embodiment includes a display panel 10 and a correction circuit 50, and is configured to correct luminance data on the basis of pre-stored correction data of mobility and a threshold voltage so as to supply the corrected luminance data to the display panel 10.

The display panel 10 has a pixel of respective colors of red, green, and blue (RGB). Input data (pixel data: luminance data) which are voltage signals of luminance of each pixel are inputted separately for each of the colors of RGB, whereby the display panel 10 is capable of controlling a display of every color. Each of R data, G data, and B data is luminance data of 8 bits, for example, and one pixel can be composed of dots (sub pixels) of three colors of RGB. In addition, a coordinate of a dot in a display area is denoted as (X, Y).

The correction circuit 50 includes multipliers 51R, 51G, and 51B, a memory read-out unit 52, a memory 52*a*, square root operation units 53R, 53G, and 53B, adders 54R, 54G, and 54B, correlation tables 55R, 55G, and 55B, and D/A converters 56R, 56G, and 56B.

The multipliers 51R, 51G, and 51B are provided for respective colors of RGB. R data, G data, and B data of inputted video data are respectively supplied to the multiplier 51R, the multiplier 51G, and the multiplier 51B. To the multipliers 51R, 51G, and 51B, mobility correction values Δμ (=1/μ') for correcting variation of the mobility of a driving transistor for every pixel are respectively supplied from the memory read-out unit 52.

The memory read-out unit 52 reads out mobility correction values Δμ, which are used for correcting variation of the mobility for every pixel, from the memory 52*a* on the basis of a coordinate signal (X coordinate, Y coordinate) so as to supply the mobility correction values Δμ to the multipliers 51R, 51G, and 51B respectively. Further, the memory read-out unit 52 supplies the mobility correction values Δμ for every pixel, which are read out, to the correlation tables 55R, 55G, and 55B respectively. Mobility correction values Δμ for all pixels may be determined by using mobility of a driving transistor of a pixel circuit of a specific pixel which is positioned at a top-left corner of the display panel 10, for example, as a reference. The memory 52*a* takes a storage capacity only for storing mobility correction values Δμ of respective colors for each pixel. A nonvolatile memory such as a flash memory and EEPROM is applicable as the memory 52*a*.

Here, a coordinate signal inputted into the memory read-out unit 52 is produced by a coordinate production unit (not shown) in synchronization with the input data (pixel data) of RGB on the basis of a clock that synchronizes with a vertical synchronization signal, a horizontal synchronization signal, and pixel data of the input data. Then the coordinate signal produced as this is supplied to the memory read-out unit 52.

The multipliers 51R, 51G, and 51B multiply R data, G data, and B data (input signal voltages) of inputted video data respectively by the mobility correction values Δμ (=1/μ') for respective colors which are supplied from the memory read-out unit 52. Then the multiplication results are respectively supplied as outputs to the square root operation units 53R, 53G, and 53B for determining a square root.

After square roots of the input signal voltages for respective colors are calculated in the square root operation units 53R, 53G, and 53B, the square roots are respectively supplied to the adders 54R, 54G, and 54B as outputs. To the adders 54R, 54G, and 54B, threshold voltage correction values ΔVth (=−Vth') used for correcting variation of the threshold voltage of a driving transistor for every pixel are respectively supplied from the correlation tables 55R, 55G, and 55B.

The correlation tables 55R, 55G, and 55B use a correlation between the mobility μ and the threshold voltage Vth so as to produce threshold voltage correction values ΔVth for respective colors from mobility correction values Δμ which are supplied from the memory read-out unit 52 and supply the threshold voltage correction values ΔVth to the adders 54R, 54G, and 54B respectively. The correlation tables 55R, 55G, and 55B may be stored in a memory of a microprocessor (not shown) which is included in the display device, for example. Alternatively, an arbitrary memory provided in the display device may store the tables and other functions.

The correlation tables 55R, 55G, and 55B are independently provided for respective colors of RGB in case of a simultaneous access of RGB. However, data contents of the correlation tables 55R, 55G, and 55B may be independent or the same. Data contents (correction values) to be stored in the correlation tables 55R, 55G, and 55B and a method for determining the correction values will be described later.

The adders 54R, 54G, and 54B add the threshold voltage correction values ΔVth (=−Vth') for respective colors which are supplied from the correlation tables 55R, 55G, and 55B respectively to R data, G data, and B data which are supplied from the square root operation units 53R, 53G, and 53B.

Then outputs of the adders 54R, 54G, and 54B are supplied to the D/A converters 56R, 56G, and 56B and converted into analog data signals so as to be supplied to input terminals for respective colors in the display panel 10. Consequently, an organic EL element is driven in each pixel by a current corresponding to the data signals of respective colors that are corrected for every pixel.

As above, in the embodiment, luminance non-uniformity occurring in an organic EL element of the display panel 10 due to a problem in manufacturing can be corrected for every pixel. Further, since only mobility correction values Δμ used for correction processing which is performed in a pixel circuit of each pixel are stored in the memory and threshold voltage correction values ΔVth are produced in the correction circuit with reference to the correlation tables, the storage capacity of the memory can be kept small.

The method for determining the threshold voltage correction values ΔVth to be stored in the correlation tables 55R, 55G, and 55B is now described.

Figure 5:
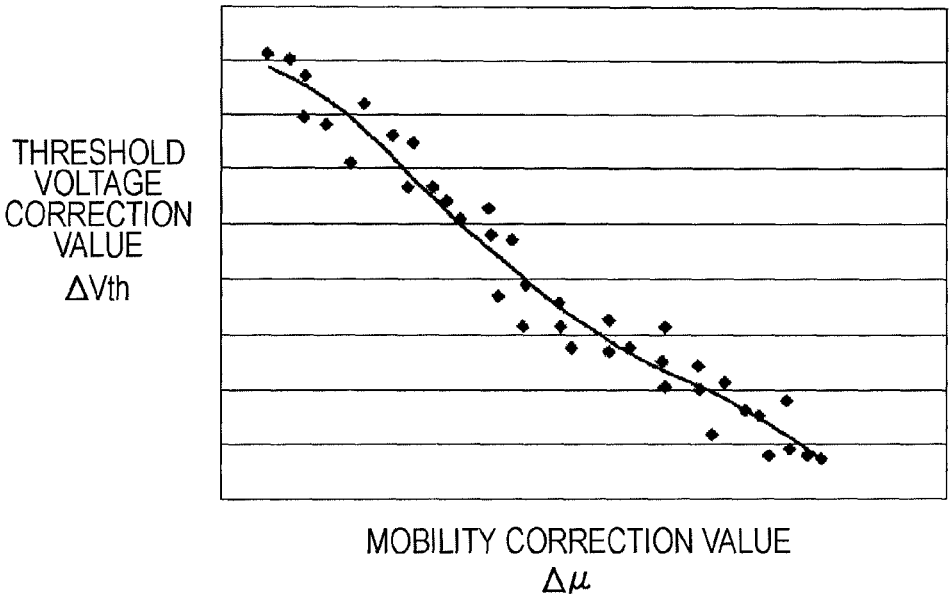
FIG. 5 is a graph for explaining interpolation calculation using polynomial approximation.

Threshold voltage correction values ΔVth to be stored in the correlation tables are basically determined from actual measurement values. However, as a method for forming correlation tables, mobility correction values Δμ which are not plotted are interpolated in order to determine outputs of threshold voltage correction values ΔVth corresponding to inputs of all mobility correction values Δμ. As an interpolating method, mobility correction values Δμ and threshold voltage correction values ΔVth are plotted on a two-dimensional graph as shown in FIG. 5 and polynomial approximation is performed.

Further, another method for determining threshold voltage correction values ΔVth to be stored in the correlation tables 55R, 55G, and 55B is described with reference to FIG. 6.

It is undesirable to provide correlation tables for inputs of all mobility correction values Δμ because the storage capacity of the memory increases. As the other method, data of mobility correction values Δμ and threshold voltage correction values ΔVth corresponding to the mobility correction values Δμ are discretely stored in a memory of a correlation table and linear interpolation is performed on the basis of the following operational Expression 2 in operational circuits. In FIG. 6, examples of discrete mobility correction values registered with the correlation table are expressed by thin arrow lines and a mobility correction value Δμ which is inputted between the discrete mobility correction values is expressed by a bold arrow line. Here, the operational circuits are respectively provided between the correlation tables 55R, 55G, and 55B and the adders 54R, 54G, and 54B in FIG. 4.

Figure 6:
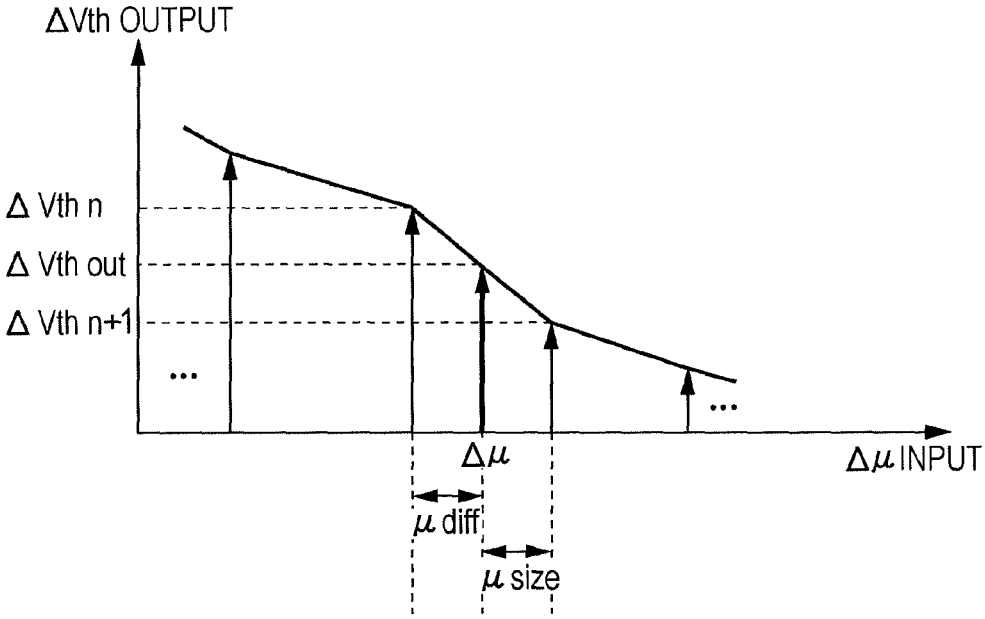
FIG. 6 is a graph for explaining a method for producing a threshold voltage correction value ΔVth from a mobility correction value Δμ by linear interpolation.

Namely, based on a mobility correction value Δμ outputted from the memory read-out unit 52, threshold voltage correction values ΔVth (ΔVth n and ΔVth n+1) corresponding to mobility correction values at two points adjacent to the mobility correction value Δμ are read out from data of threshold voltage correction values ΔVth discretely stored in the memory (the correlation table), as shown in FIG. 6. Then linear interpolation is performed by using the following operational Expression 2 so as to calculate a threshold voltage correction value ΔVth out.

$$\Delta Vth\ \text{out}=(\Delta Vth\ n+1-\Delta Vth\ n)*(\Delta\mu\text{diff}/\Delta\mu\text{size})+\Delta Vth\ n \quad (2)$$

Here, Δμ diff represents a difference between a mobility correction value, which is a smaller value between mobility correction values that are registered with the correlation table and adjacent to the mobility correction value Δμ, and the mobility correction value Δμ, and Δμ size represents a difference between the mobility correction values, registered with the correlation table, at two points adjacent to the mobility correction value Δμ.

That is, two threshold voltage correction values ΔVth n and ΔVth n+1 corresponding to two mobility correction values between which the mobility correction value Δμ is interposed as shown in FIG. 6 are acquired. Then the linear interpolation is performed by using the acquired two mobility correction values and the two threshold voltage correction values ΔVth corresponding to the two mobility correction values so as to determine a threshold voltage correction value ΔVth out which is between the discrete values and corresponds to the mobility correction value Δμ which is inputted. After that, the adders 54R, 54G, and 54B add the threshold voltage correction value ΔVth out for respective colors which is supplied from the correlation tables 55R, 55G, and 55B to R data, G data, and B data supplied from the square root operation units 53R, 53G, and 53B.

Here, a correction value to be stored in the correlation table depends on a TFT manufacturing process. Therefore, a correction value to be stored in the correlation table is not determined for each display panel but is determined for every TFT manufacturing process, being able to simplify determination of the correction value.

2. Another Embodiment

In another embodiment, a threshold voltage correction value ΔVth is stored in a memory, and a mobility correction value Δμ is produced in response to an input of the threshold voltage correction value ΔVth by using a correlation table.

Figure 7:
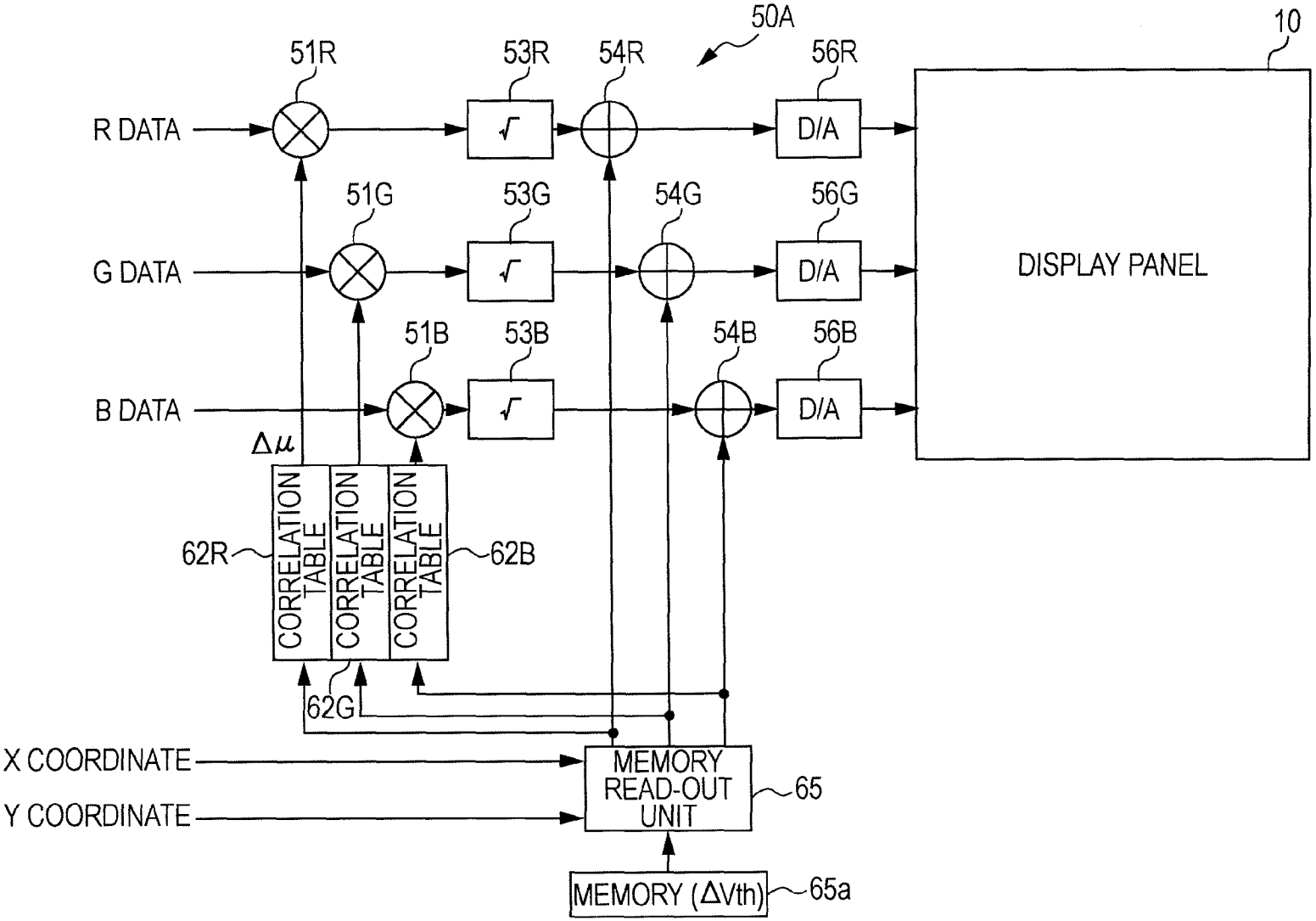
FIG. 7 shows another embodiment of a block diagram for correcting a threshold voltage and mobility.

FIG. 7 illustrates a block diagram, according to the other embodiment, for correcting a threshold voltage and mobility. In FIG. 7, same reference characters are given to elements corresponding to those in FIG. 4. The description below is focused on elements different from those in FIG. 4 and detailed description of elements corresponding to those in FIG. 4 is skipped.

Referring to FIG. 7, an organic EL display device includes the display panel 10 and a correction circuit 50A. The correction circuit 50A includes the multipliers 51R, 51G, and 51B, a memory read-out unit 65, a memory 65*a*, the square root operation units 53R, 53G, and 53B, the adders 54R, 54G, and 54B, correlation tables 62R, 62G, and 62B, and the D/A converters 56R, 56G, and 56B.

To the multiplier 51R, the multiplier 51G, and the multiplier 51B, R data, G data, and B data of inputted video data are respectively supplied. To the multipliers 51R, 51G, and 51B, mobility correction values Δμ (=1/μ') for correcting variation of the mobility of a driving transistor for every pixel are respectively supplied from the correlation tables 62R, 62G, and 62B.

The correlation tables 62R, 62G, and 62B use a correlation between the mobility μ and the threshold voltage Vth so as to produce mobility correction values Δμ for respective colors from the threshold voltage correction values ΔVth which are supplied from the memory read-out unit 65 and supply the mobility correction values Δμ to the multipliers 51R, 51G, and 51B respectively. As is the case with FIG. 4, the correlation tables 62R, 62G, and 62B may be stored in a memory of a microprocessor (not shown) which is included in the display device, for example. Alternatively, an arbitrary memory provided in the display device may store the tables and other functions.

Further, the correlation tables 62R, 62G, and 62B are independently provided for respective colors of RGB in case of a simultaneous access of RGB, as is the case with FIG. 4. However, data contents of the correlation tables 62R, 62G, and 62B may be independent or the same. Data contents (correction values) to be stored in the correlation tables 62R, 62G, and 62B and a method for determining the correction values are similar to those of the previous embodiment.

The memory read-out unit 65 reads out threshold voltage correction values ΔVth, which are used for correcting variation of the threshold voltage for every pixel, from the memory 65*a* on the basis of a coordinate signal (X coordinate, Y coordinate) so as to supply the threshold voltage correction values ΔVth to the correlation tables 62R, 62G, and 62B respectively. Further, the memory read-out unit 65 supplies the threshold voltage correction values ΔVth (=−Vth'), which are read out, for every pixel to the adders 54R, 54G, and 54B respectively. The memory 65*a* takes a storage capacity only for storing threshold voltage correction values ΔVth of respective colors for each pixel. A nonvolatile memory such as a flash memory and EEPROM is applicable as the memory 65*a*.

Here, a coordinate signal inputted into the memory read-out unit 65 is produced in synchronization with the input data (pixel data) of RGB by a coordinate production unit (not shown) in the same manner as FIG. 4.

The multipliers 51R, 51G, and 51B multiply R data, G data, and B data (input signal voltages) of inputted video data respectively by the mobility correction values Δμ for respective colors which are supplied from the correlation tables 62R, 62G, and 62B. Then the multiplication results are respectively supplied as outputs to the square root operation units 53R, 53G, and 53B used for determining a square root.

After square roots of the input signal voltages for respective colors are calculated in the square root operation units 53R, 53G, and 53B, the square roots are supplied to the adders 54R, 54G, and 54B as outputs. To the adders 54R, 54G, and 54B, threshold voltage correction values ΔVth used for correcting variation of the threshold voltage of a driving transistor for every pixel are respectively supplied from the memory read-out unit 65.

The adders 54R, 54G, and 54B add the threshold voltage correction values ΔVth for respective colors which are supplied from the memory read-out unit 65 respectively to R data, G data, and B data which are supplied from the square root operation units 53R, 53G, and 53B.

Then outputs of the adders 54R, 54G, and 54B are supplied to the D/A converters 56R, 56G, and 56B and converted into analog data signals so as to be supplied to input terminals for respective colors in the display panel 10. Consequently, an organic EL element is driven in each pixel by a current corresponding to the data signals of respective colors that are corrected for every pixel.

As above, in the embodiment, luminance non-uniformity occurring in an organic EL element of the display panel 10 due to a problem in manufacturing can be corrected for every pixel in the same manner as the previous embodiment. Further, since only mobility correction values Δμ used for correction processing which is performed in a pixel circuit of each pixel are stored in the memory and threshold voltage correction values ΔVth are produced in the correction circuit in reference to the correlation tables, the storage capacity of the memory can be kept small.

It should be noted that the embodiments described above are specific examples of a preferred embodiment of the present invention and therefore include various limitations which are technically preferable. However, the present invention is not limited to these embodiments unless specific description limiting the invention is given. Accordingly, it should be understood that the present invention is not limited to the above-mentioned embodiments and various modifications and alterations may occur as they are within the scope of the present invention.

For example, though the display device of the above embodiments is applied to an organic EL display device, the display device is applicable to any display device as long as the display device includes an active matrix TFT panel based on the current driving method.

For example, the circuit structure and a series of processing described above may be realized by hardware or software. Further, it goes without saying that the function performing the series of processing can be realized by a combination of hardware and software.

The present application contains subject matter related to that disclosed in Japanese Priority Patent Application JP 2009-182819 filed in the Japan Patent Office on Aug. 5, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A correction circuit, comprising:

a memory configured to store one of a mobility correction value and a threshold voltage correction value that are used for correcting luminance non-uniformity for every pixel, the luminance non-uniformity being caused by variations in mobility of a carrier in a channel region and a threshold voltage of a driving transistor included in a pixel circuit of a pixel constituting a display panel and being a correction object;

a memory read-out unit configured to read out one of the mobility correction value and the threshold voltage correction value that are stored in the memory;

a correlation table configured to produce one of a threshold voltage correction value and a mobility correction value from the other one of the mobility correction value and the threshold voltage correction value that are read out by the memory read-out unit, on the basis of a correlation between the mobility and the threshold voltage;

a mobility correction means for correcting an input signal for every pixel by using the mobility correction value supplied from one of the memory read-out unit and the correlation table; and a threshold voltage correction means for correcting the input signal for every pixel, the input signal being corrected at the mobility correction means, by using the threshold voltage correction value supplied from one of the memory read-out unit and the correlation table.

2. The correction circuit according to claim 1, further comprising:

a D/A converter configured to convert the input signal that is corrected at an adder of the threshold voltage correction means into an analog signal and output the analog signal to the display panel; wherein the memory stores the mobility correction value;

the memory read-out unit reads out the mobility correction value stored in the memory;

the correlation table produces the threshold voltage correction value from the mobility correction value read out by the memory read-out unit;

the mobility correction means includes a multiplier that multiplies a digital input signal by the mobility correction value supplied from one of the memory read-out unit and the correlation table so as to correct the input signal for every pixel; and the threshold voltage correction means includes a square root operation unit that performs a square root operation with respect to the input signal corrected at the multiplier, and the adder that adds the threshold voltage correction value supplied from one of the memory read-out unit and the correlation table to the input signal outputted from the square root operation unit so as to correct the input signal for every pixel.

3. The correction circuit according to claim 2, wherein the correlation table stores a polynomial approximation curve between the mobility correction value and the threshold voltage correction value, and one correction value is produced from the other correction value on the basis of the polynomial approximation curve.

4. The correction circuit according to claim 2, wherein the correlation table discretely stores information of a correlation between the mobility correction value and the threshold voltage correction value, and a mobility correction value between mobility correction values stored in the correlation table and a threshold voltage correction value between threshold voltage correction values stored in the correlation table are produced by linear interpolation.

5. The correction circuit according to claim 1, further comprising:

a D/A converter configured to convert the input signal that is corrected at an adder of the threshold voltage correction means into an analog signal and output the analog signal to the display panel; wherein the memory stores the threshold voltage correction value;

the memory read-out unit reads out the threshold voltage correction value stored in the memory;

the correlation table produces the mobility correction value from the threshold voltage correction value read out by the memory read-out unit;

the mobility correction means includes a multiplier that multiplies a digital input signal by the mobility correction value supplied from the correlation table so as to correct the input signal for every pixel; and the threshold voltage correction means includes a square root operation unit that performs a square root operation with respect to the input signal corrected at the multiplier, and the adder that adds the threshold voltage correction value supplied from the memory read-out unit to the input signal outputted from the square root operation unit so as to correct the input signal for every pixel.

6. The correction circuit according to claim 5, wherein the correlation table stores a polynomial approximation curve between the mobility correction value and the threshold voltage correction value, and one correction value is produced from the other correction value on the basis of the polynomial approximation curve.

7. The correction circuit according to claim 5, wherein the correlation table discretely stores information of a correlation between the mobility correction value and the threshold voltage correction value, and a mobility correction value between mobility correction values stored in the correlation table and a threshold voltage correction value between threshold voltage correction values stored in the correlation table are produced by linear interpolation.

8. A display device, comprising:

a correction circuit that includes a display panel configured to have a plurality of pixels each of which has a pixel circuit based on a current driving method, a memory configured to store one of a mobility correction value and a threshold voltage correction value that are used for correcting luminance non-uniformity for every pixel, the luminance non-uniformity being caused by variations in mobility of a carrier in a channel region and a threshold voltage of a driving transistor included in the pixel circuit of the pixels constituting the display panel, a memory read-out unit configured to read out one of the mobility correction value and the threshold voltage correction value that are stored in the memory, a correlation table configured to produce one of the threshold voltage correction value and the mobility correction value from the other one of the mobility correction value and the threshold voltage correction value that are read out by the memory read-out unit, on the basis of a correlation between the mobility and the threshold voltage, a mobility correction means for correcting an input signal for every pixel by using the mobility correction value supplied from one of the memory read-out unit and the correlation table, and a threshold voltage correction means for correcting the input signal for every pixel, the input signal being corrected at the mobility correction means, by using the threshold voltage correction value supplied from one of the memory read-out unit and the correlation table.

9. A correction circuit, comprising:

a memory configured to store one of a mobility correction value and a threshold voltage correction value that are used for correcting luminance non-uniformity for every pixel, the luminance non-uniformity being caused by variations in mobility of a carrier in a channel region and a threshold voltage of a driving transistor included in a pixel circuit of a pixel constituting a display panel and being a correction object;

a memory read-out unit configured to read out one of the mobility correction value and the threshold voltage correction value that are stored in the memory;

a correlation table configured to produce one of a threshold voltage correction value and a mobility correction value from the other one of the mobility correction value and the threshold voltage correction value that are read out by the memory read-out unit, on the basis of a correlation between the mobility and the threshold voltage;

a mobility correction unit configured to correct an input signal for every pixel by using the mobility correction value supplied from one of the memory read-out unit and the correlation table; and a threshold voltage correction unit configured to correct the input signal for every pixel, the input signal being corrected at the mobility correction unit, by using the threshold voltage correction value supplied from one of the memory read-out unit and the correlation table.

10. A display device, comprising:

a correction circuit that includes a display panel configured to have a plurality of pixels each of which has a pixel circuit based on a current driving method, a memory configured to store one of a mobility correction value and a threshold voltage correction value that are used for correcting luminance non-uniformity for every pixel, the luminance non-uniformity being caused by variations in mobility of a carrier in a channel region and a threshold voltage of a driving transistor included in the pixel circuit of the pixels constituting the display panel, a memory read-out unit configured to read out one of the mobility correction value and the threshold voltage correction value that are stored in the memory, a correlation table configured to produce one of the threshold voltage correction value and the mobility correction value from the other one of the mobility correction value and the threshold voltage correction value that are read out by the memory read-out unit, on the basis of a correlation between the mobility and the threshold voltage, a mobility correction unit configured to correct an input signal for every pixel by using the mobility correction value supplied from one of the memory read-out unit and the correlation table, and a threshold voltage correction unit configured to correct the input signal for every pixel, the input signal being corrected at the mobility correction unit, by using the threshold voltage correction value supplied from one of the memory read-out unit and the correlation table.

* * * * *